US010973380B2

(12) United States Patent
Seo et al.

(10) Patent No.: US 10,973,380 B2
(45) Date of Patent: Apr. 13, 2021

(54) CLEANER HOLDER AND CLEANER UNIT

(71) Applicant: LG Electronics Inc., Seoul (KR)

(72) Inventors: Jonghyun Seo, Seoul (KR); Mantae Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/992,723

(22) Filed: Aug. 13, 2020

(65) Prior Publication Data

US 2020/0367710 A1 Nov. 26, 2020

Related U.S. Application Data

(63) Continuation of application No. 16/525,140, filed on Jul. 29, 2019.

(30) Foreign Application Priority Data

Jul. 30, 2018 (KR) ..... 10-2018-0088838
Sep. 10, 2018 (KR) ..... 10-2018-0107841

(51) Int. Cl.

| | |
|---|---|
| ***A47L 9/00*** | (2006.01) |
| ***A47L 9/28*** | (2006.01) |
| ***A47L 11/20*** | (2006.01) |
| ***A47L 11/202*** | (2006.01) |

(52) U.S. Cl.

CPC ..... *A47L 9/0063* (2013.01); *A47L 9/2873* (2013.01); *A47L 9/2884* (2013.01); *A47L 11/201* (2013.01); *A47L 11/202* (2013.01)

(58) Field of Classification Search

CPC .... A47L 9/0063; A47L 9/2873; A47L 9/2884; A47L 11/201; A47L 11/202

See application file for complete search history.

(56) References Cited

U.S. PATENT DOCUMENTS

| | | | |
|---|---|---|---|
| 9,155,431 | B2 | 10/2015 | Dyson et al. |
| 10,194,779 | B2 | 2/2019 | Kim et al. |
| 10,299,650 | B2 | 5/2019 | Kim et al. |
| 10,299,651 | B2 | 5/2019 | Kim et al. |
| 10,314,453 | B2 | 6/2019 | Kim et al. |

(Continued)

FOREIGN PATENT DOCUMENTS

| | | | |
|---|---|---|---|
| CN | 205031171 | U | 2/2016 |
| CN | 206518524 | U | 9/2017 |

(Continued)

OTHER PUBLICATIONS

Office Action received in Korean Patent Application No. 10-2018-0107841 from the Korean Intellectual Property Office (KIPO) dated Aug. 21, 2019.

(Continued)

*Primary Examiner* — Andrew A Horton

(74) *Attorney, Agent, or Firm* — Finnegan, Henderson Farabow, Garrett & Dunner, LLP

(57) ABSTRACT

A cleaner holder comprises a base, a stand coupled to the base and extending upward from the base, a support body coupled to an upper portion of the stand and configured to support a cleaner, and a cleaning module support coupled to the stand and configured to support a cleaning module of the cleaner. The cleaning module may be detachably coupled to an extension tube of the cleaner.

14 Claims, 8 Drawing Sheets

(56) References Cited

U.S. PATENT DOCUMENTS

| | | | | |
|---|---|---|---|---|
| 10,342,404 | B2 | 7/2019 | Kim et al. | |
| 10,405,717 | B2 | 9/2019 | Kim et al. | |
| 10,405,719 | B2 | 9/2019 | Kim et al. | |
| 2007/0022950 | A1 | 2/2007 | Livingston | |
| 2011/0219571 | A1 | 9/2011 | Dyson et al. | |
| 2017/0196419 | A1* | 7/2017 | Brown | H02J 7/0045 |
| 2017/0319034 | A1 | 11/2017 | Kim et al. | |
| 2017/0319035 | A1 | 11/2017 | Kim et al. | |
| 2017/0319036 | A1 | 11/2017 | Kim et al. | |
| 2017/0319037 | A1 | 11/2017 | Kim et al. | |
| 2017/0319038 | A1 | 11/2017 | Kim et al. | |
| 2017/0319039 | A1 | 11/2017 | Kim et al. | |
| 2018/0125314 | A1 | 5/2018 | Kim et al. | |
| 2018/0199777 | A1 | 7/2018 | Kim et al. | |
| 2018/0199778 | A1 | 7/2018 | Kim et al. | |
| 2018/0199779 | A1 | 7/2018 | Kim et al. | |
| 2019/0133394 | A1 | 5/2019 | Kim et al. | |
| 2019/0223673 | A1 | 7/2019 | Kim et al. | |
| 2019/0274506 | A1 | 9/2019 | Kim et al. | |

FOREIGN PATENT DOCUMENTS

| | | | |
|---|---|---|---|
| EP | 03412185 | | 12/2018 |
| JP | 2005110787 | A | 4/2005 |
| JP | 2010-213886 | A | 9/2010 |
| JP | 2014124443 | A | 7/2014 |
| JP | 3210454 | U | 5/2017 |
| JP | 3210455 | U | 5/2017 |
| KR | 20-19970020803 | U | 6/1997 |
| KR | 10-0445805 | B1 | 8/2004 |
| KR | 10-0667875 | | 1/2007 |
| KR | 10-2012-0103956 | A | 9/2012 |
| KR | 10-1595727 | B | 2/2016 |
| KR | 10-2017-0126377 | A | 11/2017 |
| KR | 10-1815820 | B | 1/2018 |
| KR | 10-2018-0057491 | | 5/2018 |
| KR | 10-2018-0059402 | A | 6/2018 |
| KR | 10-2018-0015692 | A | 2/2019 |
| TW | 201739405 | A | 11/2017 |
| TW | M558019 | U | 4/2018 |

OTHER PUBLICATIONS

Office Action received in Korean Patent Application No. 10-2019-0079648 from the Korean Intellectual Property Office (KIPO) dated Jul. 21, 2019.

International Search Report received in PCT Application No. PCT/KR2019/008225 from the Korean Intellectual Property Office (KIPO) dated Oct. 17, 2019.

Office Action from the Taiwan Patent Office in Taiwanese Patent Application No. 108126405, dated Oct. 22, 2019; pp. 1-6.

Office Action from the Korean Intellectual Property Office (KIPO) in Korean Patent Application No. KR 10-2019-0079648, dated Nov. 13, 2019; pp. 1-64.

Korean Office Action in Korean Application No. 10-2020-0050003 dated Dec. 1, 2020 (70 pages).

* cited by examiner

CLEANER HOLDER AND CLEANER UNIT

CROSS-REFERENCE TO RELATED APPLICATIONS

The present application is a continuation of U.S. Non-Provisional patent application Ser. No. 16/525,140, filed on Jul. 29, 2019, which claims priority under 35 U.S.C. 119 and 35 U.S.C. 365 to Korean Patent Application No. 10-2018-0088838, filed on Jul. 30, 2018, and Korean Patent Application No. 10-2018-0107841, filed on Sep. 10, 2018, the disclosures of which are hereby incorporated by reference in their entireties.

BACKGROUND

The present disclosure relates to a cleaner holder and a cleaner unit.

A cleaner is a device that performs cleaning by sucking and wiping dust or foreign substances from a region to be cleaned.

Such a cleaner may be classified into a manual cleaner that performs cleaning while a user directly moves the cleaner or an automatic cleaner that performs cleaning while the cleaner drives itself. The manual cleaner may be classified into a canister cleaner, an upright cleaner, a handheld cleaner, a stick cleaner, or the like, depending on type of the cleaner.

The above-described cleaner may have a rechargeable battery embedded therein, and the rechargeable battery may supply electric power for operating the cleaner only when being frequently charged. Thus, the cleaner requires a holder that can simultaneously charge the rechargeable battery and hold the cleaner.

Contents of a vacuum cleaner holder are disclosed in Korean Patent Application Publication No. 10-2012-0103956.

The vacuum cleaner holder, according to Korean Patent Application Publication No. 10-2012-0103956, includes a pedestal for holding a head of a vacuum cleaner to simultaneously charge and hold the vacuum cleaner and a support having charging pins for charging the vacuum cleaner.

The holder only serves to seat the cleaner. Therefore, in the case of various accessories such as nozzles to be connected to the cleaner, a user needs to keep them separately. Consequently, a storage space is required, and there is a possibility that accessories may get lost.

SUMMARY

Embodiments of the present disclosure provide a cleaner holder capable of storing accessories, such as a water cleaning module, which may be connected to a cleaner, while also separately holding the cleaner.

Embodiments of the present disclosure also provide a cleaner holder that can be stored in a state in which a mop attachable to a water cleaning module is detached.

Embodiments of the present disclosure also provide a cleaner holder and a cleaner unit, capable of stably supporting a cleaner by lowering the center of gravity of the cleaner holder itself.

In one embodiment, a cleaner holder may comprise a base, a stand coupled to the base and extending upward from the base, a support body coupled to an upper portion of the stand and configured to support a cleaner comprising an extension tube and a cleaning module configured to detachably couple to the extension tube, and a cleaning module support coupled to the stand and configured to support the cleaning module of the cleaner.

The cleaning module may comprise a floor cleaning module configured to suction dust, and a water cleaning module configured to perform water cleaning.

The water cleaning module may comprise a rotary cleaning portion comprising a mop, and a driving device configured to rotate the rotary cleaning portion.

The rotary cleaning portion may further comprise a mop plate coupled to the mop and coupled to the driving device to rotate.

The mop plate may include a pair of mop plates.

The water cleaning module may further include a water tank configured to supply water to the rotary cleaning portion.

The cleaning module support may be positioned between the support body and the base.

When the cleaning module is coupled to the cleaning module support, the cleaning module may be positioned between the support body and the base.

The cleaning module support may be detachably coupled to the stand.

The cleaner holder may further comprise an extra nozzle positioned behind the extension tube toward the stand. The extra nozzle may be replaceable with the cleaning module.

The cleaning module support may be positioned behind the extra nozzle relative to the extension tube.

The extra nozzle and the cleaning module may be coupled to at least one of the support body or the stand at different heights.

The cleaning module support may be positioned below the extra nozzle.

The extra nozzle may include a plurality of extra nozzles, and the plurality of extra nozzles may be fixed to positions above the cleaning module support.

The cleaner holder may further comprise a first charging terminal for charging a battery mounted to the cleaner; and a second charging terminal for charging an auxiliary battery.

The battery and the auxiliary battery may be charged at different heights.

When the cleaning module is coupled to the cleaning module support, the auxiliary battery may be disposed to overlap the cleaning module in a vertical direction.

The cleaning module support may be positioned on a virtual straight line passing through a central axis of the extension tube and a central axis of the stand at the same height.

The cleaning module support may comprise a stand coupling portion coupled to and surrounding the stand.

The stand coupling portion may comprise a hollow through which the stand may pass.

The stand coupling portion may comprise a module coupling portion, and the cleaning module may be coupled to the module coupling portion.

When the cleaner is supported by the support body while the extension tube is coupled to the cleaner, and the cleaning module is coupled to the module coupling portion, the cleaning module may be positioned between the extension tube and the stand.

When the cleaning module is coupled to the module coupling portion, the cleaning module may be positioned between the support body and the base.

The cleaning module support may further comprise a mop storage portion configured to store the mop.

The mop storage portion may be integrally formed with the stand coupling portion, or may be detachably coupled to the stand coupling portion.

The mop storage portion may be positioned on an opposite side of the module coupling portion relative to the stand.

The mop storage portion may comprise an upper surface opening, and when the mop is seated on the mop storage portion, the mop may protrude upward from the mop storage portion.

The lower surface of the mop storage portion may be rounded, and a water discharge hole for water discharge may be formed therein.

In another embodiment, a cleaner holder may comprise a base, a stand extending upward from the base; a support body coupled above the stand and defining a cleaner support surface protruding such that a cleaner is seated thereon, and a cleaning module support disposed between the support body and the base and configured to support a cleaning module, the cleaning module being detachably coupled to an extension tube of the cleaner.

When the cleaner is supported by the support body, the extension tube may be spaced apart from the stand and the cleaning module support in a protruding direction of the cleaner support surface.

The protruding direction of the cleaner support surface may be defined as a direction extending forward from the stand.

A first extension line drawn along a central axis of the extension tube may be positioned in front of a second extension line drawn along a central axis of the stand and positioned behind a third extension line drawn downward along a front surface of the cleaner.

The cleaner may comprise a handle positioned in front of the stand.

The extension tube may extend downward between a front end and a rear end of the handle.

The first extension line may be positioned behind a fourth extension line drawn along a protruding direction of a finger guide, the finger guide protruding from the handle.

The cleaner may comprise a cleaner body coupled to the extension tube and seated on the cleaner support surface, and a battery mounted to the cleaner body.

The battery may be positioned between a first extension line drawn along a central axis of the extension tube and a second extension line drawn along a central axis of the stand.

The support body may comprise a first body comprising a charging terminal for charging the battery, and a second body protruding from the first body by a predetermined distance and defining the cleaner support surface.

The cleaner support surface may be an upper surface of the second body.

In addition, the predetermined distance may be smaller than a minimum distance between the first extension line drawn along the central axis of the extension tube and the second extension line drawn along the central axis of the stand.

The support body may be positioned above a space formed between the extension tube and the stand.

In another embodiment, a cleaning unit may comprise a cleaner and a holder placed on a floor surface to support the cleaner at a predetermined height relative to the floor surface. The holder may comprise a support body configured to support the cleaner, a stand coupled to a lower side of the support body and extending downward from the support body, a base coupled to a lower side of the stand and placed on the floor surface, and a cleaning module support coupled to the stand and configured to support a cleaning module, the cleaning module being detachably coupled to the cleaner.

The stand may be configured to shift at least a part of the weight of the cleaner to the base when the cleaner is seated on the support body, and the cleaning module support and the stand may be configured to shift the weight of the cleaning module to the base when the cleaning module is supported by the cleaning module support.

The cleaner may further comprise an extension tube and a suction nozzle detachably coupled to the extension tube.

When the suction nozzle is coupled to the extension tube and the cleaner is seated on the support body while the extension tube is coupled to the cleaner, the suction nozzle may be seated on the base, and the extension tube and the suction nozzle may be configured to shift a part of the weight of the cleaner to the base.

The cleaning module support may be coupled to the stand between the support body and the base.

When the cleaner is seated on the support body while the extension tube is coupled to the cleaner, and the cleaning module is supported by the cleaning module support, the cleaning module may be positioned between the extension tube and the stand.

The holder may form an accommodation space configured to accommodate an auxiliary battery separate from the cleaner. Specifically, the support body may comprise an accommodation space configured to accommodate the auxiliary battery separate from the cleaner. When the auxiliary battery is accommodated in the support body, the load of the auxiliary battery may be shifted to the base through the stand.

When the auxiliary battery is accommodated in the support body and the cleaning module is supported by the cleaning module support, the auxiliary battery may overlap the cleaning module in the vertical direction.

When the cleaner is supported to the support body while the auxiliary battery is accommodated in the support body, the cleaning module is supported by the cleaning module support, and the battery is mounted to the cleaner, the auxiliary battery may be positioned between the battery mounted to the cleaner and the cleaning module.

When the cleaner is supported by the support body while the battery is mounted to the cleaner, and the cleaning module is supported by the cleaning module support, the battery may overlap the cleaning module in the vertical direction.

In another embodiment, a cleaner unit may comprise a cleaner body comprising a suction motor to provide suction force, a battery mounted to the cleaner body, an auxiliary battery separate from the cleaner body, an extension tube coupled to the cleaner body, a suction nozzle detachably coupled to the extension tube, and a holder. The auxiliary battery may be mounted to the holder for charging, and the holder may be configured to support the cleaner body at a predetermined height from a floor surface.

The cleaner body may be supported between the battery and the auxiliary battery.

When the cleaner is supported by the holder, the predetermined height may be defined between the height of the battery and the height of the auxiliary battery.

The cleaner unit may further comprise a dust container coupled to the cleaner body.

The holder may comprise a base in contact with the floor surface, a stand extending upward from the base, and a support body coupled to an upper portion of the stand and configured to support the cleaner body.

The holder may further comprise a cleaning module support detachably coupled to the stand and configured to support a cleaning module. The cleaning module may be configured to detachably couple to the cleaner body.

When the cleaner body is supported by the holder, the suction nozzle may be in contact with the upper surface of the base.

The upper surface of the base that is in contact with the suction nozzle may comprise an inclined surface.

The holder may form an accommodation space configured to accommodate the auxiliary battery.

When the auxiliary battery is accommodated in the accommodation space, the auxiliary battery may be charged independently of the battery.

When the auxiliary battery is mounted to the holder, the auxiliary battery may be positioned below the battery.

When the cleaner is supported by the support body while the battery is mounted to the cleaner, the auxiliary battery may be positioned along the vertical direction of the battery.

The details of one or more embodiments are set forth in the accompanying drawings and the description below. Other features will be apparent from the description and drawings, and from the claims.

DETAILED DESCRIPTION OF THE EMBODIMENTS

Figure 1:
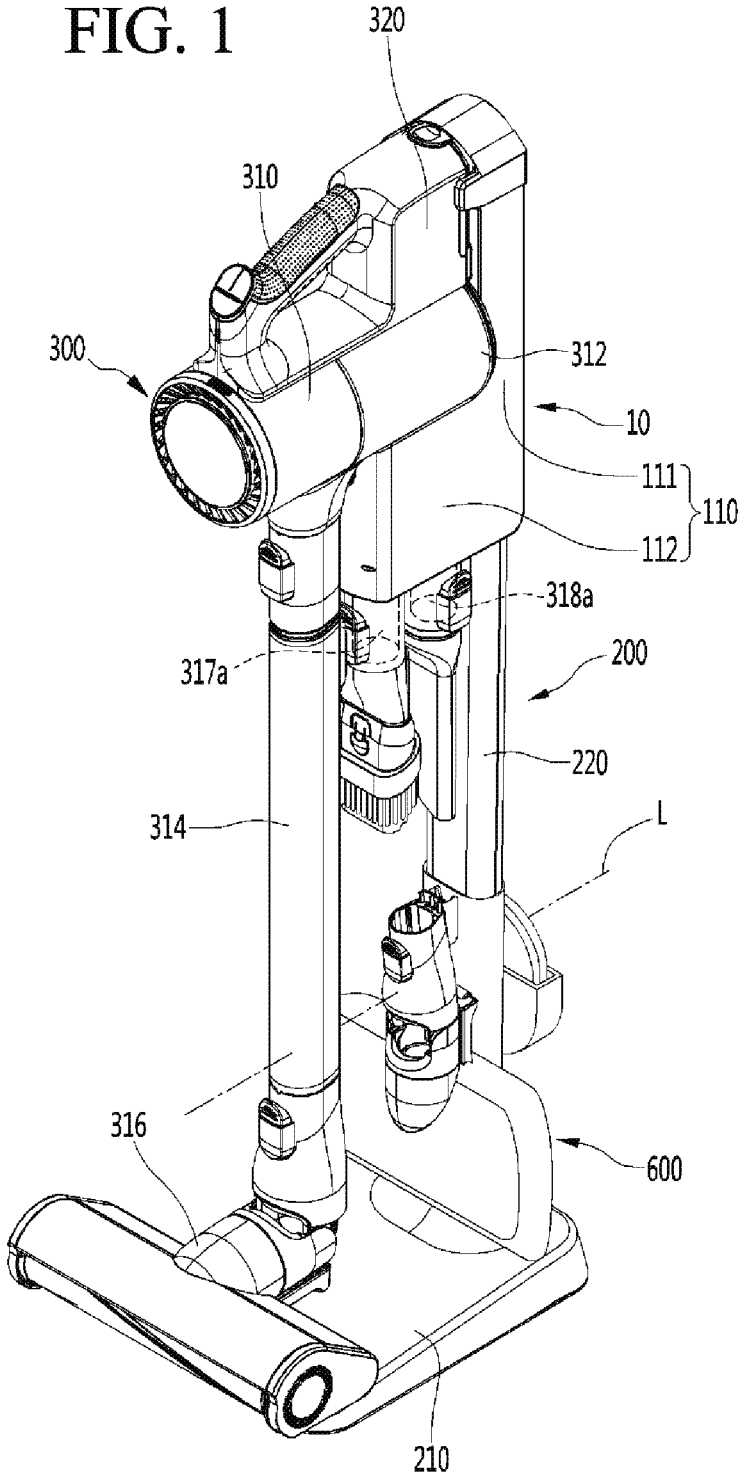
FIG. 1 is a perspective view illustrating a state in which a cleaner is seated on a cleaner holder according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
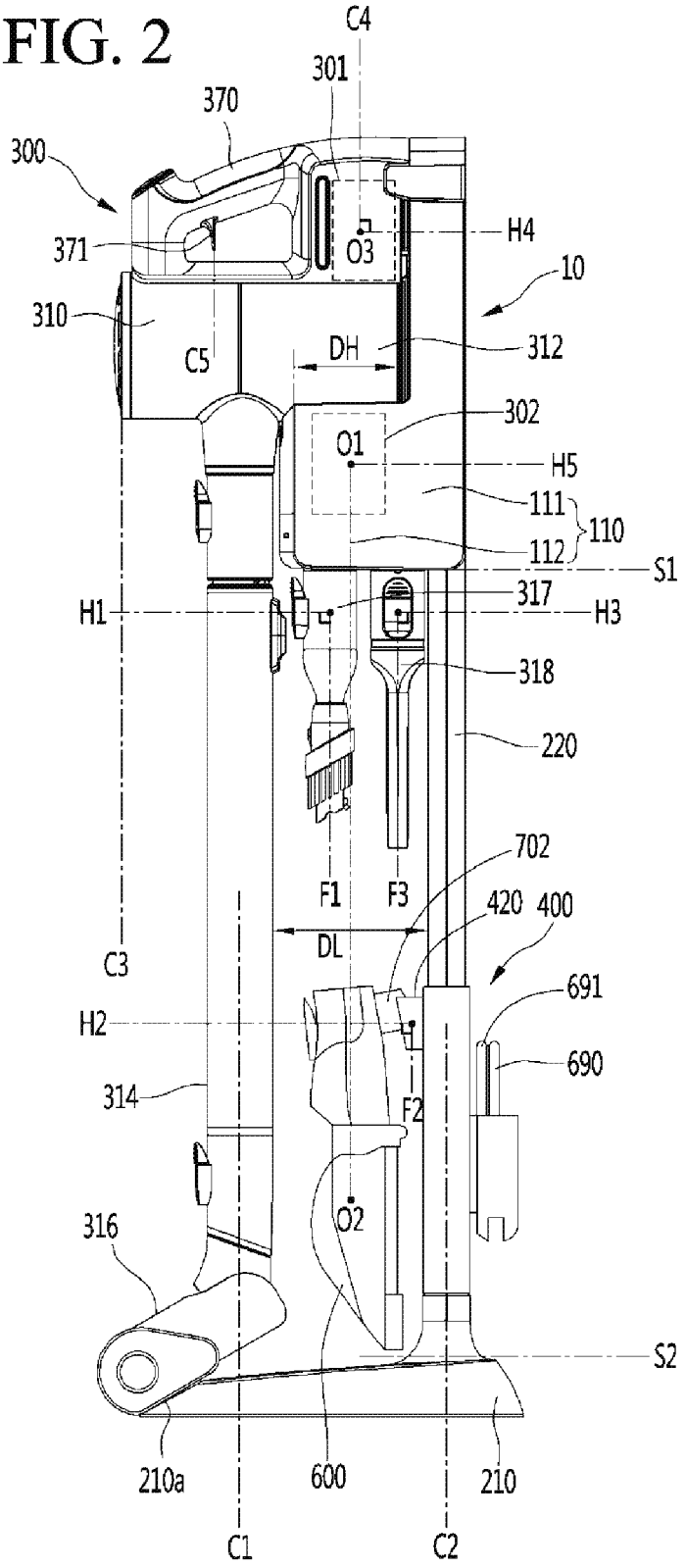
FIG. 2 is a side view of the cleaner holder of FIG. 1 according to an embodiment of the present disclosure.
Figure 3:
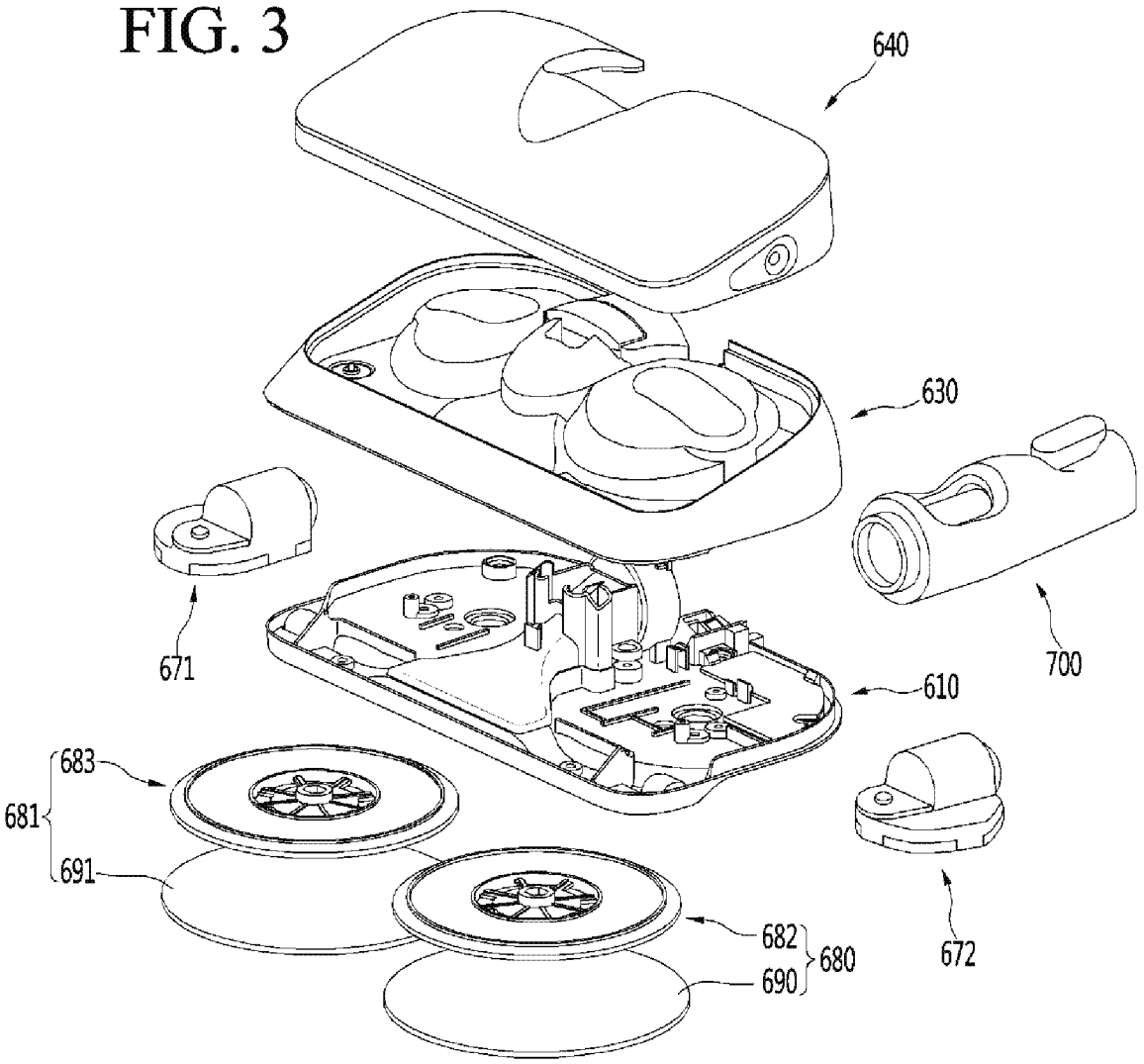
FIG. 3 is an exploded perspective view of a water cleaning module that may be used in connection with a cleaner according to an embodiment of the present disclosure.

FIG. 1 is a perspective view illustrating a state in which a cleaner is seated on a cleaner holder according to an embodiment of the present disclosure, FIG. 2 is a side view of the cleaner holder of FIG. 1 according to an embodiment of the present disclosure, and FIG. 3 is an exploded perspective view of a water cleaning module that may be used in connection with a cleaner according to an embodiment of the present disclosure.

Referring to FIGS. 1 to 3, a cleaner holder 10 according to an embodiment of the present disclosure may include a support body 110 for supporting a cleaner 300.

The support body 110 may support the cleaner 300 and charge a battery 301 mounted to the cleaner 300.

The cleaner 300 may include a cleaner body 310 having a suction motor, and a battery housing 320 in which the battery 301 may be accommodated.

An extension tube 314 to which a suction nozzle 316 is coupled may be coupled to the cleaner body 310. Air and dust may be suctioned through the suction nozzle 500 by suction force generated by the suction motor.

In addition, a discharge port through which the suctioned air is discharged via an internal filter may be formed on the front surface of the cleaner body 310.

External air may be introduced into the cleaner body 310 through the suction nozzle 316 and the extension tube 314 by suction force generated by the suction motor. The cleaner body 310 may include a dust container 312 in which dust contained in air introduced through the suction nozzle 316 may be collected.

Also, the cleaner body 310 may include a handle 370 that the user can grip.

The handle 370 will be described in detail with reference to FIG. 2.

The handle 370 may extend from one side of the battery housing 320 to the front end of the cleaner body 310. For example, the handle 370 may extend from the upper end of the battery housing 320 in a first direction (e.g., forward), be bent in a second direction (e.g., downward), and extend to the front end of the cleaner body 310.

The handle 370 may extend to form a hole into which a user's hand is inserted. That is, the hole may be formed between the handle 370 and the dust container 312.

The handle 370 may extend in a cylindrical shape having a predetermined radius so that the user can grip the handle 370.

The handle 370 may be provided with a finger guide 371 that may limit the movement of the hand in a state in which the user grips the handle 370. The finger guide 371 may be referred to as a "movement limiting portion".

The finger guide 371 may protrude in a direction in which the hole is formed.

For example, the finger guide 371 may extend in a vertical direction from the inner circumferential surface of the handle 370 defining the hole. The end of the finger guide 371 may be spaced apart from the inner circumferential surface of the handle 370 in the extending direction of the finger guide 371.

Therefore, in a state in which the user grips the handle 370, some of the fingers may be positioned on one side of the finger guide 371, and the other fingers may be positioned on the other side of the finger guide 371. For example, the finger guide 371 may be positioned between the index finger and the middle finger.

Therefore, the user may minimize the force required when the user holds the handle 370 to push or pull the cleaner 300.

The support body 110 may include a first body 111 having a first charging terminal for charging the battery 301 mounted to the cleaner 300.

The support body 110 may further include a second body 112 protruding from the first body 111.

The second body 112 may protrude from the front end of the first body 111 by a predetermined distance DH. That is, the predetermined distance DH may be understood as a minimum length from the front end of the first body 111 to the front end of the second body 112. The second body 112 may support a part of the cleaner 300.

In detail, the upper surface of the second body 112 may support the cleaner body 310. Accordingly, the cleaner 300 may be stably seated on the support body 110. Here, the upper surface of the second body 112 may be referred to as a "cleaner support surface". Thus, the predetermined distance DH may be referred to as the length DH of the cleaner support surface.

Meanwhile, the second body 112 may define the upper end of the space formed by the extension tube 314 and a stand 220 described later in the front-rear direction.

That is, according to the second body 112 extending forward from the first body 111, it may be possible to form the space for storing the accessory to be described later. Thus, the user access to the accessory may be facilitated.

In addition, according to the second body 112 defining the bottom surface of the support body 110, the extension tube 314 may be coupled to the cleaner body 310 without any spatial interference of the support unit 200, which will be described later. Therefore, the user may easily combine or separate the cleaner 300 to the holder 10 without any spatial interference, thereby improving user convenience.

The cleaner body 310 may be seated on the upper surface of the second body 112. In other words, in addition, the support body 110 may accommodate an auxiliary battery 302 that may be mounted to the cleaner 300. For example, the second body 112 may include a second charging terminal for accommodating the auxiliary battery 302 and charging the accommodated auxiliary battery 302.

The charging of the cleaner 300 by the first charging terminal (charging of the battery 301 mounted to the cleaner 300) and the charging of the auxiliary battery 302 by the second charging terminal may be independently performed.

Specifically, the charging of the cleaner 300 and the charging of the auxiliary battery 302 may be performed at the same time, or one charging may be performed and then the other charging may be performed. For example, after the battery 301 of the cleaner 300 is fully charged by the first charging terminal, the charging of the auxiliary battery 302 by the second charging terminal may be started.

Extra nozzles 317 and 318 may be coupled to the support body 110. The extra nozzles 317 and 318 may be detachable to the cleaner, or the like. In general, the cleaner may include a plurality of nozzles 317, 318, and 600 that may be replaced with the suction nozzle 316, depending on the purpose.

Therefore, the unused nozzles 317, 318, and 600 may be disadvantageously inconvenient to store.

However, if the extra nozzles 317 and 318 are stored in a state of being coupled to the support body 110 as in the embodiment of the present disclosure, the risk of losing the extra nozzles 317 and 318 may be reduced and ease of use may be improved. Here, the unused nozzles, that is, the extra nozzles 317 and 318, and the water cleaning module 600 to be described later may be referred to as "accessories".

The extra nozzles 317 and 318 may be coupled to the lower side of the support body 110.

The accessories may be positioned between a lower end S1 of the second body 112 and an upper end S2 of the base 210.

The holder 10 of the cleaner may further include a support unit 200 for supporting the support body 110.

The support unit 200 may include a base 210 on a floor and a stand 220 provided on the base 210.

The stand 220 may be coupled to the upper side of the base 210 and may extend upward. The stand 220 may be detachably coupled to the support body 110.

For example, the lower end of the stand 220 may be coupled to the base 210, and the upper end of the stand 220 may be coupled to the support body 110. The stand 220 may be coupled to the lower side of the first body 111.

The stand 220 may be coupled to the first body 111 at a position lower than the center of gravity of the support body 110. Although not limited thereto, the center of gravity of the support body 110 may be positioned directly above the stand 220.

Therefore, the support body 110 may be positioned at a predetermined height on the floor by the stand 220.

The length of the stand 220 may be longer than the length of the extra nozzles 317 and 318. Therefore, the extra nozzles 317 and 318 may be spaced apart from the upper surface of the base 210 in a state in which the extra nozzles 317 and 318 are coupled to the support body 110.

The extra nozzles 317 and 318 may be disposed at positions F1 and F3 in front of the stand 220.

In other words, the virtual extension lines F1 and F3 extending along the central axes of the extra nozzles 317 and 318 may be positioned forward of the virtual extension line C2 extending along the central axis of the stand 220 and/or the virtual extension line F3 of the module coupling portion 420 to be described later.

An extension tube 314 of the cleaner 300 may be positioned forward of the extra nozzles 317 and 318.

In other words, the virtual extension line C1 extending along the central axis of the extension tube 314 may be positioned forward of the virtual extension lines F1 and F3 of the extra nozzles 317 and 318.

Here, the virtual extension line C1 drawn along the central axis of the extension tube 314 may be referred to as a first extension line. The virtual extension line C2 drawn along the central axis of the stand 220 may be referred to as a second extension line.

Thus, the extra nozzles 317 and 318 may be positioned between the first extension line C1 and the second extension line C2.

Further, the extension tube 314 may be positioned behind the virtual extension line C3, which may be drawn directly downward along the front surface of the cleaner body 310. The extension tube 314 may be positioned behind the virtual extension line C5 drawn along the extending direction of the finger guide 371 protruding directly downward to the handle 370 of the cleaner 300.

Here, the virtual extension line C3, which may be drawn directly downward along the front surface of the cleaner body 310, may be referred to as a third extension line. The virtual extension line C5 drawn along the extending direction of the finger guide 371 may be referred to as a fourth extension line.

The cleaner holder 10 may further include nozzle supports 317*a* and 318*b* to which the extra nozzles 317 and 318 may be selectively coupled.

The nozzle supports 317*a* and 318*b* may be coupled to at least one of the support body 110 or the stand 220. For example, the nozzle supports 317*a* and 318*b* may be formed to extend downward from the bottom surface of the support body 110.

The user may attach and detach the respective nozzles 317 and 318 to and from the nozzle supports 317*a* and 318*b* as necessary.

Accordingly, the extra nozzles 317 and 318 may be easily stored and used, thereby improving user convenience.

In order for the extra nozzles 317 and 318 to be coupled, the nozzle supports 317*a* and 318*b* may be formed in, for example, a cylindrical shape. The nozzle supports 317*a* and 318*b* may be fitted to the extra nozzles 317 and 318.

The extra nozzles 317 and 318 may be provided with locking hooks that are movably installed. For example, the locking hooks may be engaged with or disengaged from the nozzle supports 317*a* and 318*b* by the operation of the user.

A water cleaning module 600 capable of suctioning air and wiping the floor surface by using a mop with water may be detachably coupled to the extension tube 314 of the cleaner 300.

For example, the water cleaning module 600 may include module housings 610 and 630, a coupling tube 700 provided in the module housings 610 and 630, one or more rotary cleaning portions 680 and 681 rotatably coupled to the lower sides of the module housings 610 and 630, and one or more driving devices 671 and 672 provided in the module housings 610 and 630 to drive one or more rotary cleaning portions 680 and 681.

The water cleaning module 600 may further include a water tank 640 that is seated above the module housings 610 and 630. Water stored in the water tank 640 may be supplied to the rotary cleaning portions 680 and 681 through the module housings 610 and 630 via an internal flow path.

The rotary cleaning portions 680 and 681 may include mops 690 and 691 and mop plates 682 and 683, to which the mops 690 and 691 may be attached. The water in the water tank 640 may be supplied to the mops 690 and 691 through the mop plates 682 and 683.

The mop plates 682 and 683 may be coupled to the driving devices 671 and 672 and rotated below the module housings 610 and 630.

The mop plates 682 and 683 may be provided as a pair. The mops 690 and 691 may also be provided as a pair. Accordingly, the mops 690 and 691 may be attached to and detached from the mop plates 682 and 683, respectively.

The mops 690 and 691 may be in contact with the floor surface to clean the floor surface during the rotation process.

When the user couples the suction nozzle 316 to the extension tube 314 of the cleaner 300, it may be possible to carry out cleaning in such a manner that dust on the floor surface is suctioned.

On the other hand, when the suction nozzle 316 is separated from the extension tube 314 of the cleaner 300 and the water cleaning module 600 is coupled to the extension tube 314, the suction of the dust on the floor surface and the water cleaning on the floor surface may be performed.

In this manner, any one of the suction nozzle 316 and the water cleaning module 600 may be selected and coupled to the extension tube 314, and the other one should be stored so as to prevent loss.

In the present embodiment, the suction nozzle 316 may be referred to as a "floor cleaning module".

When the cleaner 300 is supported by the support body 110 in a state in which the suction nozzle 316 is coupled to the extension tube 314, the suction nozzle 316 may be seated on the upper surface of the base 210.

In detail, the upper surface of the base 210 on which the suction nozzle 316 is seated may form an inclined surface inclined downward toward the front end.

That is, the front end 210*a* of the base 210 may be formed as an inclined surface to support the suction nozzle 316 (see FIG. 2).

Due to this, the front end 210*a* of the base 210 may stably support the extension tube 314, and the support body 110 may stably support the cleaner body 310.

That is, the cleaner 300 may be stably supported by the base 210 and the support body 110. As a result, the cleaner 300 may be supported at two positions of the holder 10. The two positions may be positioned at the upper and lower sides of the holder 10, respectively, and may be spaced apart from each other. Therefore, the cleaner 300 may be stably fixed to the holder 10.

In the present embodiment, in order to store the cleaning module not used, the cleaner holder 10 may further include a cleaning module support 400 for storing the cleaning module.

In the cleaner holder 10 of the present embodiment, there may be an extra space between the extension tube 314 and the stand 220 and between the extra nozzles 317 and 318 and the base 210.

The extra space may define the front-rear direction by the first extension line C2 and the second extension line C2. In detail, the first extension line C2 may be spaced apart from the second extension line C2 by a predetermined length DL. Here, the predetermined length DL may be understood as a minimum distance between the first extension line C1 and the second extension line C2.

The minimum distance DL may be longer than the length DH of the cleaner support surface described above (see FIG. 2).

Accordingly, in order to prevent the volume of the holder 10 from increasing, to facilitate storage, and to allow the user to easily access the stored cleaning module, the cleaning module may be supported on the cleaning module support 400 in a state of being positioned in the extra space.

In addition, the cleaning module support 400 may be positioned on a virtual straight line L passing through the extension tube 314 and the stand 220. The cleaning module may be supported by the cleaning module support 400.

That is, the virtual straight line L may pass through the extension tube 314, the stand 220, and the cleaning module support 400.

Here, the virtual straight line L may pass through the extension tube 314 and the stand 220 at the same height from the ground. In detail, the virtual straight line L may be drawn to pass through one point of the second extension line C2 positioned at the same height as one point of the first extension line C1.

That is, the virtual straight line L may be understood as a straight line passing through the central axis of the extension tube 314 and the central axis of the stand 220 at the same height from the ground.

Since the cleaning module support 400 may be positioned on the virtual straight line L, the center of the cleaning module coupled to the extension tube 314, the stand 220, and the cleaning module support 400 may be aligned in the front-rear direction.

Due to this, since the cleaning module coupled to the cleaning module support 400 may be arranged to overlap the extension tube 314 or the stand 220 in the front-rear direction, it may be possible to provide a clear appearance when the user views the front of the holder 10. In addition, there may be an advantage that the size of the cleaner 300 and the holder 10 occupying a space may be minimized.

In addition, when expressed with reference to the cleaning module support 400, the cleaning module support 400 may be positioned at a height H2 lower than the heights H1 and H3 of the extra nozzles 317 and 18 in the extra space. The cleaning module support 400 may be positioned (F2) behind the extra nozzles 317 and 318.

Hereinafter, an example in which the water cleaning module may be supported by the cleaning module support 400 will be described.

Figure 4:
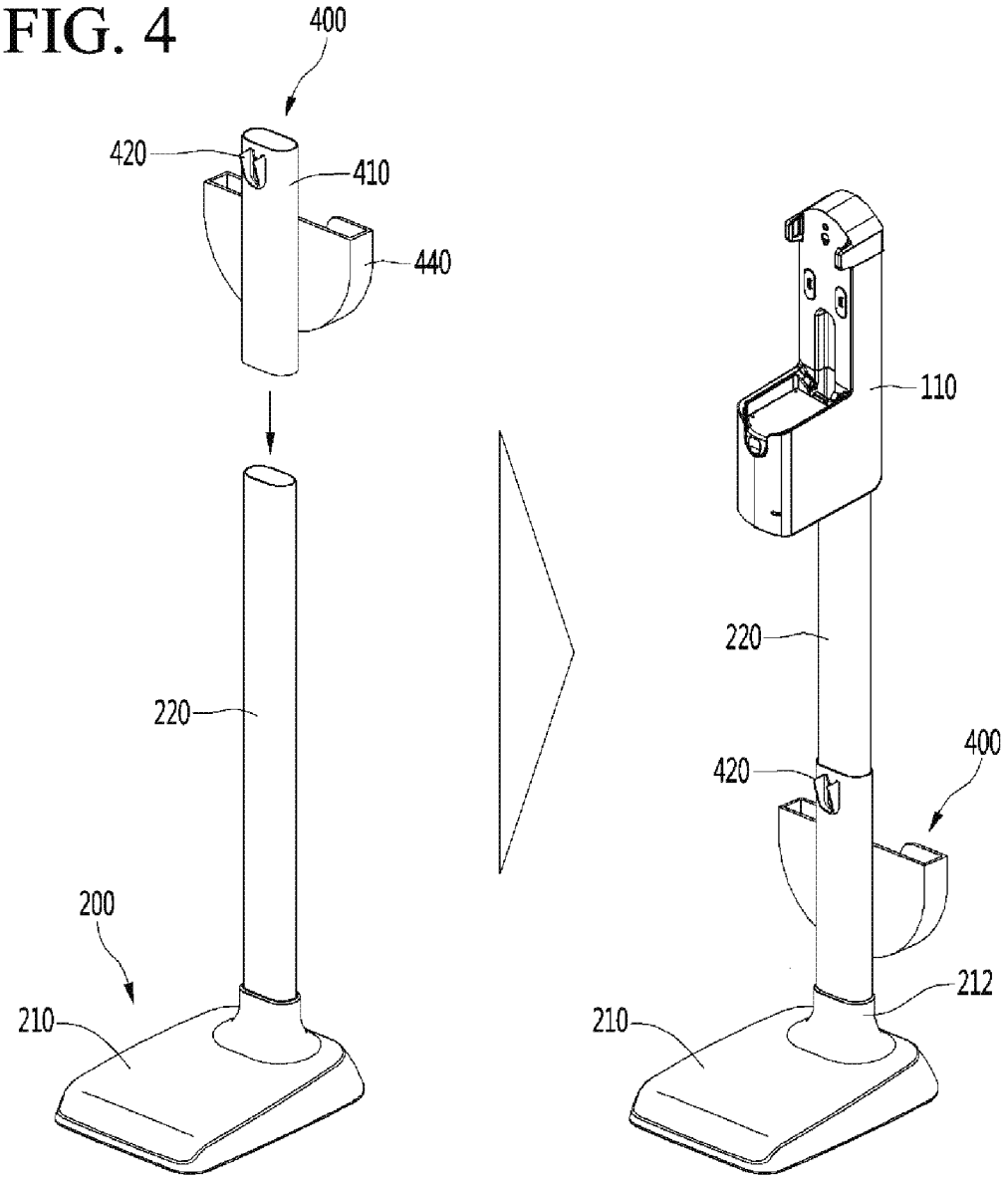
FIG. 4 is a view illustrating a process of assembling a cleaner holder according to an embodiment of the present disclosure.
Figure 5:
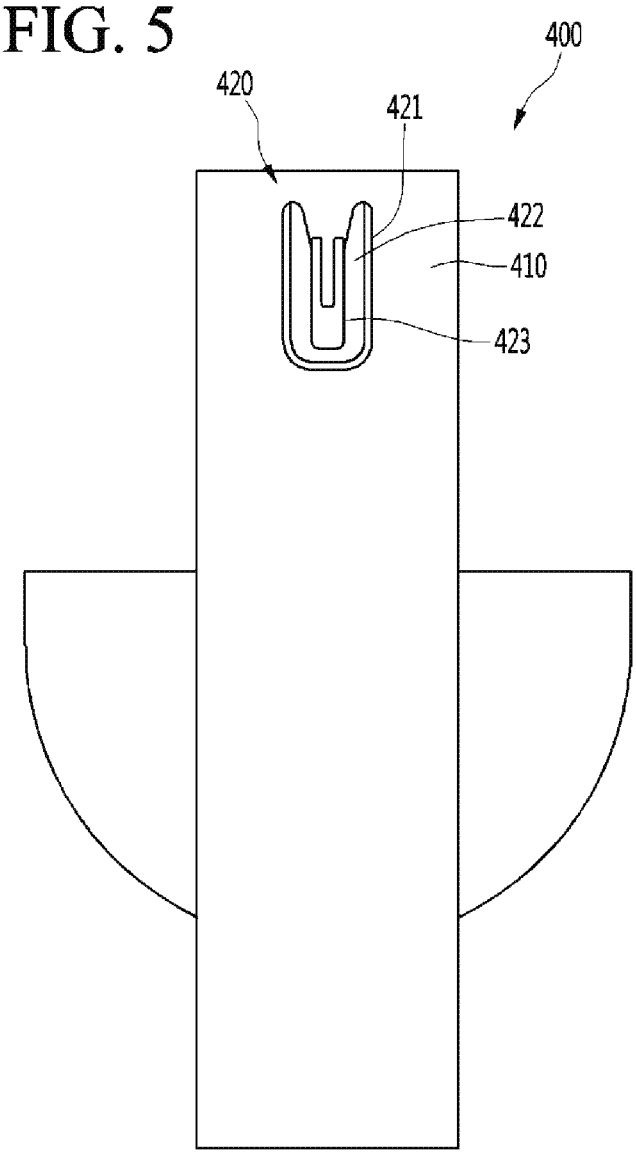
FIG. 5 is a front view of a cleaning module support according to an embodiment of the present disclosure.
Figure 6:
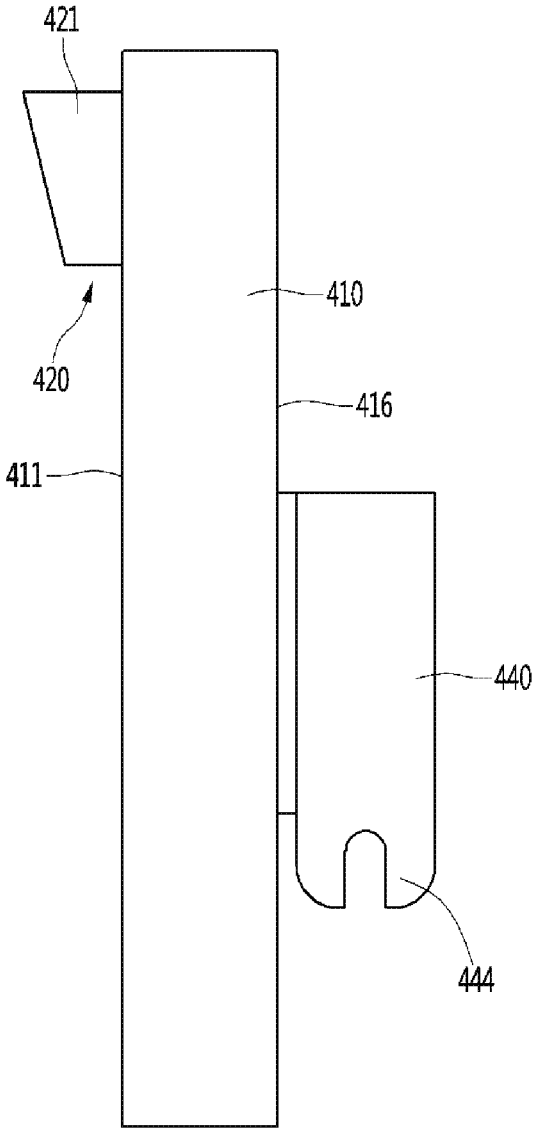
FIG. 6 is a side view of the cleaning module support according to an embodiment of the present disclosure.
Figure 7:
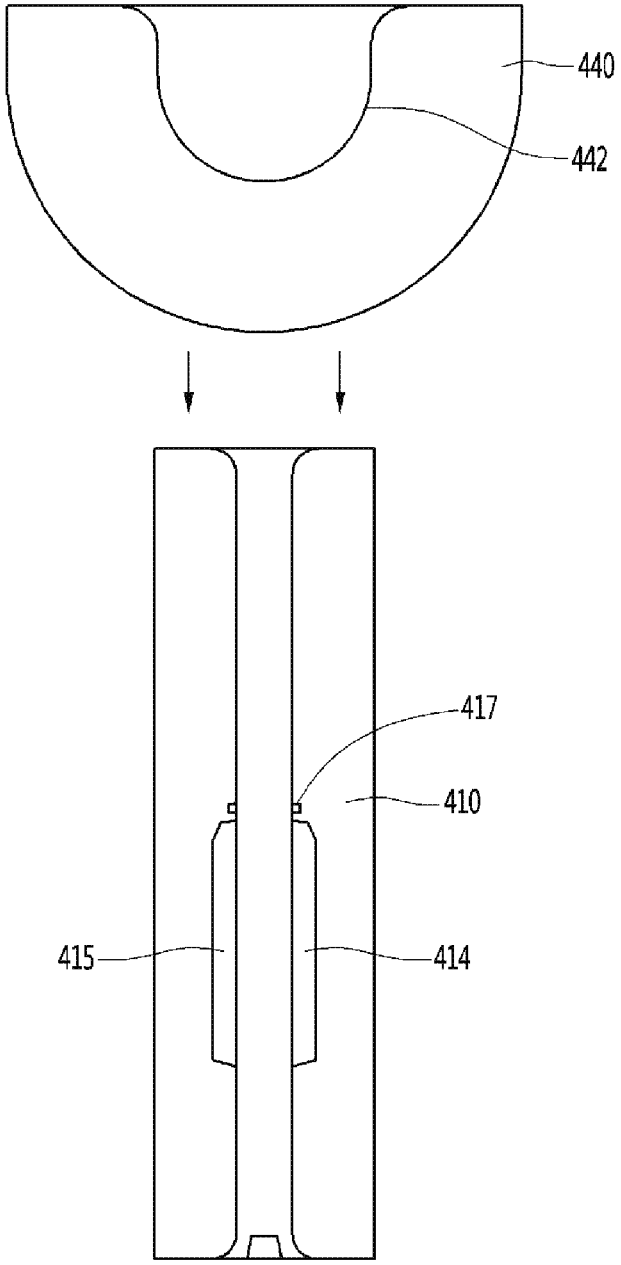
FIG. 7 is a view illustrating a state in which a mop storage portion is coupled to a stand coupling portion according to an embodiment of the present disclosure.
Figure 8:
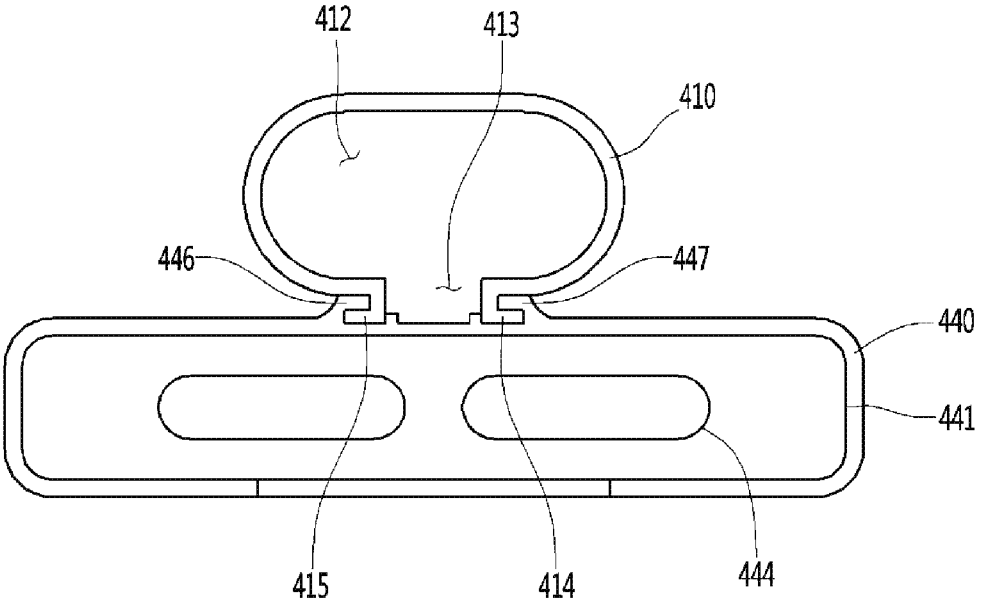
FIG. 8 is a plan view illustrating a state in which a mop storage portion is coupled to a stand coupling portion according to an embodiment of the present disclosure.

FIG. 4 is a view illustrating a process of assembling a cleaner holder according to an embodiment of the present disclosure, FIG. 5 is a front view of a cleaning module support according to an embodiment of the present disclosure, FIG. 6 is a side view of the cleaning module support according to an embodiment of the present disclosure, FIG. 7 is a view illustrating a state in which a mop storage portion is coupled to a stand coupling portion according to an embodiment of the present disclosure, and FIG. 8 is a plan view illustrating a state in which a mop storage portion is coupled to a stand coupling portion according to the embodiment of the present disclosure.

Referring to FIGS. 4 to 8, the cleaning module support 400 according to the present embodiment may be coupled to surround the stand 220.

For example, the cleaning module support 400 may include a stand coupling portion 410 coupled to the stand 220 so as to pass therethrough. The stand coupling portion 410 may include a hollow 412 through which the stand 220 may pass. That is, the cleaning module support 400 may be coupled to or separated from the stand 220 through the hollow 412.

The stand coupling portion 410 may be seated in a neck portion 212 of the base 210 in a state in which the stand 220 passes through the hollow 412 of the stand coupling portion 410. The stand 220 may be coupled to the neck portion 212 of the base 210.

A module coupling portion 420 for coupling the water cleaning module 600 may be provided on the front surface 411 of the stand coupling portion 410. Each of the water cleaning module 600 and the floor cleaning module may be provided with a coupling rib 702 to be coupled to the module coupling portion 420.

The module coupling portion 420 may protrude forward from the front surface 411 of the stand coupling portion 410. Here, the module coupling portion 420 may be positioned (F3) behind the positions F1 and F3 to which the extra nozzles 317 and 318 are coupled.

The module coupling portion 420 may include a pair of extension portions 421 protruding from the front surface 411 of the stand coupling portion 410 and spaced apart in the horizontal direction, and a coupling portion 422 connecting the front ends of the pair of extension portions 421. A space in which the coupling rib 702 may be disposed may be formed by the pair of extension portions 421 and the coupling portion 422.

The coupling portion 422 may be provided with a slot 423 for accommodating a part of the coupling rib 702 so as to couple the coupling rib 702.

Therefore, a part of the coupling rib 702 may be disposed in the slot 423, and the other part thereof may be disposed in the space formed by the pair of extension portions 421 and the coupling portion 422.

The cleaning module support 400 may further include a mop storage portion 440 for independently storing the mops 690 and 691. The mop storage portion 440 may be integrally formed with the stand coupling portion 410, or may be detachably coupled to the stand coupling portion 410.

Hereinafter, an example in which the mop storage portion 440 is detachably coupled to the stand coupling portion 410 will be described.

The mop storage portion 440 may be coupled to, for example, the rear surface 416 of the stand coupling portion 410. That is, the mop storage portion 440 may be positioned on the opposite side of the module coupling portion 420 with respect to the stand 220.

When the mop storage portion 440 is coupled to the rear surface 416 of the stand coupling portion 410, the mops 690 and 691 may be positioned behind the stand 220.

Accordingly, when the water cleaning module 600 is coupled to the module coupling portion 420, the mops 690 and 691 may be covered by the water cleaning module 600, thereby minimizing the exposure to the outside.

Since the mops 690 and 691 may be formed in a disk shape, the mop storage portion 440 may be formed in a substantially semicircular shape in a vertical section so as to store the disk-shaped mops 690 and 691.

The mop storage portion 440 may include an upper surface opening 441, and the lower surface thereof for supporting the mops 690 and 691 may be rounded.

Therefore, when the mops 690 and 691 are stored in the mop storage portion 440, the lower sides of the mops 690 and 691 may be supported on the rounded surface, and a part of the mops 690 and 691 may protrude upward from the mop storage portion 440.

Accordingly, the user may take out the mops 690 and 691 by holding the portion of the mop storage portion 440 protruding upward from the mop 690 and 691.

In addition, a slot 442 in which a user's finger may be placed may be formed in the mop storage portion 440 such that the user may easily hold the mops 690 and 691. The slot 442 may be formed as a portion of the upper surface of the mop storage portion 440 is recessed so as to be rounded downward.

When the mops 690 and 691 are stored in the mop storage portion 440 in a state in which the mops 690 and 691 keep water, the water of the mops 690 and 691 may be stored on the bottom of the mop storage portion 440. In this case, the mops 690 and 691 may be contaminated by the water, and bacteria may be generated.

Therefore, one or more water discharge holes 444 for discharging water from the mops 690 and 691 may be formed on the lower surface of the mop storage portion 440.

A pair of first coupling ribs 414 and 415 may provided on the stand coupling portion 410 so as to couple the mop storage portion 440 to the stand coupling portion 410, and the mop storage portion 440 may be provided with a pair of second coupling ribs 446 and 447 so as to couple with the first coupling ribs 414 and 415.

The pair of first coupling ribs 414 and 415 may be formed so as to be spaced apart in the horizontal direction and have a substantially "ㄴ"-shaped horizontal cross section.

Further, the pair of second coupling ribs 446 and 447 may be formed so as to be spaced apart in the horizontal direction, and may have a substantially "ㄱ"-shaped horizontal cross section. The first coupling ribs 414 and 415 and the second coupling ribs 446 and 447 may be formed in the opposite shapes.

Although not illustrated, the lower ends of the pair of first coupling ribs 414 and 415 may be provided with support surfaces for supporting the lower ends of the second coupling ribs 446 and 447.

Therefore, when the mop storage portion 440 is moved downward in a state in which the mop storage portion 440 is positioned above the first coupling ribs 414 and 415, the second coupling ribs 446 and 447 may be engaged with the first coupling ribs 414 and 415 such that the mop storage portion 440 may be coupled to the stand coupling portion 410.

Both ends of the stand coupling portion 410 may be spaced apart from each other when viewed from the above. That is, the space portion 413 may be formed between both ends of the stand coupling portion 410. The stand coupling portion 410 may be elastically deformed by the space portion 413.

The first coupling ribs 414 and 415 may be formed at both ends of the stand coupling portion 410.

When the interval between the pair of first coupling ribs 414 and 415 is formed to be somewhat larger than the interval between the second coupling ribs 446 and 447, the pair of first coupling ribs 414 and 415 may be elastically deformed to accumulate the elastic force while the second coupling ribs 446 and 447 may be coupled to the first coupling ribs 414 and 415. Therefore, the coupling force between the first coupling ribs 414 and 415 and the second coupling ribs 446 and 447 may be increased.

In addition, the stand coupling portion 410 may be provided with a limiting rib 417 that may limit upward movement of the mop storage portion 440 in a state in which the second coupling ribs 446 and 447 are coupled to the first coupling ribs 414 and 415. In the limiting rib 417, at least a part of the second coupling ribs 446 and 447 may be overlapped in the vertical direction.

According to the embodiment, since it may be possible to store accessories such as the water cleaning module which can be coupled to the cleaner separately from mounting the cleaner on the holder, the water cleaning module may be less likely to get lost and easy to store.

Meanwhile, in the present embodiment, the weight of the cleaner 300 may not only be supported by the support body 110 but may also be supported by the base 210.

That is, the weight of the cleaner 300 may not only be shifted to the support unit 200 (finally, the base 210) through the support body 110 but may also be shifted to the base 210 that supports the suction nozzle 316. That is, a part of the weight of the cleaner 300 may be shifted to the base 210 through the extension tube 314 and the suction nozzle 316.

In addition, the load of the auxiliary battery 302 separated from the cleaner 300 and accommodated in the second body 112 may also be transferred to the base 210.

In addition the weight of the water cleaning module 600 may be shifted to the base 210 through the cleaning module support 400 and the stand 220.

When the cleaner 300 on which the battery 301 is mounted is supported by the second body 112, the battery 301 of the cleaner 300 may overlap the auxiliary battery 302 in the vertical direction C4. Referring to FIG. 2, the auxiliary battery 302 may be spaced apart from the battery 301 in the vertical direction.

In a state in which the auxiliary battery 302 is accommodated in the support body 100 and the water cleaning module 600 is mounted to the cleaning module support 400, the auxiliary battery 302 may overlap the water cleaning module 600 in the vertical direction.

In detail, referring to FIG. 2, the center O1 of the auxiliary battery 302 and the center O1 of the water cleaning module 600 may be spaced apart from each other in the vertical direction. The water cleaning module 600 may be positioned directly below the auxiliary battery 302 (see a virtual line O1-O2).

The auxiliary battery 302 may be positioned between the battery 301 and the water cleaning module 600.

Meanwhile, the cleaner body 310 may be positioned between the battery 301 and the auxiliary battery 302.

As described above, the cleaner body 310 can be supported by the support body 110. When the cleaner 300 equipped with the battery 301 is supported by the second body 112, the cleaner body 310 may be supported to be positioned at a height H4-H5 between the battery 301 and the auxiliary battery 302.

In addition, in a state in which the cleaner 300 equipped with the battery 301 is supported by the second body 112 and the water cleaning module 600 is mounted to the cleaning module support 400, the battery 301 of the cleaner 300 may overlap the water cleaning module 600 in the vertical direction.

That is, the battery 301 may be disposed between the first extension line C1 and the second extension line C2. Therefore, the water cleaning module 600 disposed below the support body 110 may overlap the battery 301 in the vertical direction.

According to the present embodiment, since the components having the weights may be arranged so as to overlap each other in the vertical direction in a state of being mounted to or supported by the holder 10, the horizontal movement of the center of gravity of the holder 10 on which the components are mounted may be minimized, thereby maintaining the holder 10 in a stable state.

Further, since the cleaning module support 400 may be coupled to the stand 220 in a state of being positioned below the support body 110, the center of gravity of the holder 10 itself may be lowered such that the holder 10 may stably support the cleaner 300.

In the present disclosure, the cleaner 300 and the holder 10 may be collectively referred to as a "cleaner unit".

Further, according to the present disclosure, since the mops attachable to the water cleaning module may be separately stored in a state of being separated from the mop plate, the risk of losing the mops may be reduced and the mops may be easily stored.

According to the embodiments of the present disclosure, since it may be possible to store accessories such as the water cleaning module which can be coupled to the cleaner separately from mounting the cleaner on the holder, the water cleaning module may be less likely to get lost and easy to store.

In addition, according to the present disclosure, the mops attachable to the water cleaning module may be separately stored in a state of being separated from the mop plate, thereby reducing the risk of losing the mops and facilitating the storage of the mops.

Further, according to the present disclosure, since the water discharge hole may be formed in the mop storage portion, the phenomenon that the water dropped from the mops is collected and contaminated in the mop storage portion may be prevented.

Further, according to the present disclosure, since the cleaning module may be positioned forward of the mops in a state in which the mops are stored in the mop storage portion, the frontward exposure of the mops may be minimized.

Further, since the cleaning module support may be coupled to the stand in a state of being positioned below the support body of the holder, the center of gravity of the holder itself may be lowered such that the holder may stably support the cleaner.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner holder comprising:

a base;

a stand extending upward from the base;

a support body coupled above the stand and forming a cleaner support surface, wherein the cleaner support surface is configured to protrude such that a cleaner is seated thereon; and a cleaning module support coupled to the stand and configured to be positioned in a space defined between the support body and the base, wherein the cleaning module support comprises:

a stand coupling portion connected to the stand so as to be positioned behind an extension tube of the cleaner when the cleaner is supported on the support body; and a module coupling portion protruding outward from the stand coupling portion and configured to couple an unused cleaning module, wherein the unused cleaning module is configured to be detachably coupled to a suction end of the extension tube in a top and bottom direction of the stand, wherein the stand coupling portion forms a hollow connected to or separated from the stand, and wherein a length of the hollow is less than a length of the extension tube seated on the support body.

2. The cleaner holder of claim 1, wherein, when the cleaner is supported on the support body, the extension tube is positioned to be spaced apart from the stand and the cleaning module support in the protruding direction of the cleaner support surface.

3. The cleaner holder of claim 2, wherein the protruding direction of the cleaner support surface is defined forward from the stand, wherein a first extension line drawn along a central axis of the extension tube is positioned in front of a second extension line drawn along a central axis of the stand, and wherein the cleaning module support is positioned behind the first extension line.

4. The cleaner holder of claim 3, wherein a battery mounted on the cleaner is positioned between the first extension line and the second extension line when the cleaner is supported on the support body.

5. The cleaner holder of claim 4, wherein the support body comprises:

a first body comprising a charging terminal for charging the battery; and a second body protruding by a predetermined distance from the first body to form the cleaner support surface, wherein the cleaner support surface is an upper surface of the second body.

6. The cleaner holder of claim 5, wherein the predetermined distance is smaller than a minimum distance between the first extension line and the second extension line.

7. The cleaner holder of claim 1, wherein the support body is positioned above a space formed between the extension tube and the stand.

8. A cleaner unit comprising:

a cleaner; and a cleaner holder configured to support the cleaner at a predetermined height relative to a floor, wherein the cleaner comprises:

a cleaner body;

a battery mounted on the cleaner body;

an extension tube coupled to the cleaner body; and a plurality of cleaning modules configured to be detachably coupled to a suction end of the extension tube, wherein the cleaner holder comprises:

a base placed on the floor;

a stand extending upward from the base;

a support body coupled to an upper side of the stand and configured to support the cleaner body; and a cleaning module support detachably coupled to the stand and positioned in a space defined between the support body and the base, the cleaning module support being configured to be coupled to an unused cleaning module, wherein the cleaning module support comprises:

a stand coupling portion connected to the stand so as to be positioned behind the extension tube of the cleaner when the cleaner is supported on the support body; and a module coupling portion protruding outward from the stand coupling portion and configured to couple the unused cleaning module among the plurality of cleaning modules in an up and down direction of the stand, and wherein the stand coupling portion forms a hollow fitted to the stand, and wherein a length of the hollow is less than a length of the extension tube seated on the support body.

9. The cleaner holder of claim 8, wherein the cleaner holder is configured to accommodate an auxiliary battery separated from the cleaner body.

10. The cleaner holder of claim 9, wherein, when the auxiliary battery is accommodated in the cleaner holder, the auxiliary battery is independently charged to the battery.

11. The cleaner holder of claim 9, wherein, when the auxiliary battery is accommodated in the cleaner holder, the auxiliary battery is positioned below the battery.

12. The cleaner holder of claim 8, wherein the cleaner further comprises a dust container coupled to the cleaner body.

13. The cleaner holder of claim 8, wherein, when the cleaner body is supported on the support body, the cleaning module coupled to the extension tube contacts an upper surface of the base.

14. The cleaner holder of claim 13, wherein the upper surface of the base in contact with the cleaning module coupled to the extension tube is formed as an inclined surface.

* * * * *